US008267847B2

(12) United States Patent
Cummings et al.

(10) Patent No.: US 8,267,847 B2
(45) Date of Patent: Sep. 18, 2012

(54) METHOD AND APPARATUS FOR A RULES-BASED UTILIZATION OF A MINIMUM-SLIT-HEAD CONFIGURATION PLUNGER SLITTER

(75) Inventors: James A. Cummings, Phillips, WI (US); John J. Kondratuk, Kennan, WI (US); Ronald H. Schmidt, Phillips, WI (US)

(73) Assignee: Marquip, LLC, Phillips, WI (US)

( * ) Notice: Subject to any disclaimer, the term of this patent is extended or adjusted under 35 U.S.C. 154(b) by 141 days.

(21) Appl. No.: 12/579,868

(22) Filed: Oct. 15, 2009

(65) Prior Publication Data

US 2010/0093508 A1 Apr. 15, 2010

Related U.S. Application Data

(60) Provisional application No. 61/105,456, filed on Oct. 15, 2008.

(51) Int. Cl.
*B31B 1/18* (2006.01)
*B26D 1/24* (2006.01)

(52) U.S. Cl. ..... 493/367; 493/22; 493/370; 493/342; 493/373; 83/499

(58) Field of Classification Search ..... 493/8, 22, 493/340, 373, 342, 361, 362, 363, 366, 367, 493/369, 370, 371; 83/483, 498, 499
See application file for complete search history.

(56) References Cited

U.S. PATENT DOCUMENTS

| | | | | |
|---|---|---|---|---|
| 4,095,511 | A * | 6/1978 | Woolston | 493/34 |
| 4,269,097 | A * | 5/1981 | Linn | 83/482 |
| 4,506,577 | A * | 3/1985 | Shinomiya et al. | 83/499 |
| 5,125,301 | A * | 6/1992 | Miller et al. | 83/13 |
| 5,690,601 | A * | 11/1997 | Cummings et al. | 493/340 |
| 5,761,980 | A * | 6/1998 | Ima et al. | 83/500 |
| 6,103,171 | A * | 8/2000 | Cummings | 264/269 |
| 6,684,749 | B2 * | 2/2004 | Adami | 83/408 |
| 6,722,243 | B2 * | 4/2004 | Adami | 83/508.1 |
| 7,370,562 | B2 * | 5/2008 | Adachi et al. | 83/13 |
| 2001/0002560 | A1 * | 6/2001 | Aoki | 83/13 |

* cited by examiner

*Primary Examiner* — Paul R Durand
(74) *Attorney, Agent, or Firm* — Andrus, Sceales, Starke & Sawall, LLP

(57) ABSTRACT

A method and apparatus for performing an order change in a corrugator uses a minimum slit head configuration with all slit heads carried on two sides of a single tool support structure. A single robot is operable on the support structure to independently reset the positions of slit heads during a running order to prepare for subsequent order change in a most efficient manner, utilizing order scheduling that eliminates order changes that cannot be formed with the minimum slit head configuration.

16 Claims, 8 Drawing Sheets

METHOD AND APPARATUS FOR A RULES-BASED UTILIZATION OF A MINIMUM-SLIT-HEAD CONFIGURATION PLUNGER SLITTER

CROSS REFERENCE TO RELATED APPLICATIONS

This application relates to and claims priority from U.S. Provisional Patent Application Ser. No. 61/105,456, filed Oct. 15, 2008.

BACKGROUND OF THE INVENTION

The present invention pertains to a system for facilitating an order change in the dry end conversion of a corrugated paperboard web. In particular, the invention relates to a method and apparatus for accomplishing an order change using a minimum slit head configuration slitter.

In a corrugator dry end, where a corrugated paperboard web is longitudinally scored and slit into multiple parallel output webs (or "outs"), the outs are directed through one or more downstream cut-off knives which cut the output webs into selected sheet lengths. When two cut-off knives are used, they are vertically separated and each is capable of cutting the full corrugator width web. A web selector positioned downstream of the slitter/scorer, divides the outs into two groups, one of which is directed to the upper cut-off knife and the other to the lower cut-off knife. Order changes must be effected while the upstream corrugator wet end continues to produce and deliver the continuous web to the slitter/scorer. An order change will typically result in a change in widths of the output webs; requiring redirection of at least a central portion of the web from one knife level to the other and possibly changes in edge trim widths as well.

The prior art has developed two basic order change systems for corrugator dry ends utilizing double level cut-off knives. One system is known as a gapless or plunge style order change system. In this system, there are two slitter/scorer stations immediately adjacent one another in the direction of web movement and through both of which the web travels. At order change, one slitter/scorer, operating on the currently running order, will lift out of operative engagement with the web, and the other slitter/scorer which is set to the new order alignment plunges down into operative engagement with the web. The result is a small order change region of corrugated web with overlapping slits and scores for both the running and the new orders.

FIG. 1 and FIG. 2 show typical configuration of gapless order change slitter scorers. The FIG. 1 concept has a slit and score axis 110, 111 incorporated on each of two side frames 112, 113 with a trim slit waste collect chute 114, 115 for each station. FIG. 2 shows a single side frame 116 design with a score/score 117, 117/slit/slit 118, 118*a* configuration and single trim slit waste collect chute 120.

The second basic order change system is known as a gap style system. In this system, there is normally a single slitter/scorer station 121 as shown in FIG. 3. At order change, an upstream rotary shear severs the corrugated board web laterally. After the shear severs the web, the current running order is accelerated through the slitter to pull a gap between this tailing out order and the severed web emerging from the shear. As the tailing out web clears the slitter/scorer, the operative slit and score heads 122, 123 are quickly repositioned in the open gap. The leading edge of the new order then enters the slitter/scorer.

The two station gapless slitter of FIGS. 1 and 2 is preferred because it allows order changes at higher speeds and because there are inherent advantages associated with never severing the corrugated board web. Mainly, the potential for skew of either the tailing or leading edge webs is eliminated. Tailout accuracy is not affected by drastic tailout acceleration and potential for jam-up of the leading edge of the new order web is eliminated. A disadvantage of the two station plunge slitter concepts is that there is a duplication of slit and score heads that increases the cost and complexity of the slitter/scorer.

In principle, it would be possible to implement a gapless order change with a single slit axis machine 124, as shown in FIG. 4. This would involve plunging some of the heads 125 on the slit axis into the board line 126 to slit the outs associated with the running order while positioning the unused heads for the next order. Then at order change, the new order heads 125 would plunge into this board line while the old order heads 125 were removed from operative engagement with the web. In practice, this is not possible because of physical space occupied by the slit heads and the sometimes small difference between old and new order slit positions.

An approach to use of a single axis slitter to accomplish a gapless order change of FIG. 4 is described in U.S. Pat. No. 6,684,749. This concept uses pre-positioning of unused slit heads to the extent possible based on physical interference between running order slit heads and desired placement position of new order slit heads. Then, at order change, a robot 127 quickly repositions slit heads 125 as required in an order change zone between the new and old orders. While this approach solves the problem of physical interference between slit heads on the single axis slitter 124, it can create a quite long order change zone of scrap board depending upon the speed of the corrugator and the number of heads 125 that need to be moved.

OBJECTS OF THE INVENTION

An object of the invention is to achieve the continuous slitting and scoring of the corrugated web in a gapless order change with a slitter/scorer that has the fewest slit heads possible consistent with the specification for the maximum number of "outs" required.

A further objective of the invention is to minimize the length of waste material generated during the order change by accomplishing the change over from one job to the next as quickly as possible.

Another objective of a particularly advantageous embodiment of this invention is to provide a trim slit change-over method that will significantly improve order change-over reliability.

Yet another objective of the invention is to reduce the head support structure of the slitter scorer that will minimize the overall cost of the slitter/scorer.

It is also an objective of the invention to provide a slitting method that will require a small number of head positioning robots so as to reduce the overall cost and complexity of the slitter and to achieve a high reliability.

SUMMARY OF THE INVENTION

These and other objectives and advantages, which will be clear to those skilled in the art from reading the description that follows, are achieved with a slitter/scorer device that has slit heads mounted on both sides of a single support structure that allows heads from either side to be run in any combination. This allows some slit heads to be located and engaged in the web for a current running order while leaving space available for location of unused slit heads for an upcoming order.

DETAILED DESCRIPTION OF THE PREFERRED EMBODIMENTS

Prior art slitter/scorers have used two in-line series of rotary scoring tools and two in-line series of rotary slitting tools to make it possible to process one job on one series of slitting and scoring tools while the other series of slitting and scoring tools is positioned by robots for the processing of the next job. For a six-out slitter/scorer, there are a minimum of five internal slit heads required on one job. The prior art slitter/scorers utilize five internal slit heads on each slitter series.

Figure 4:
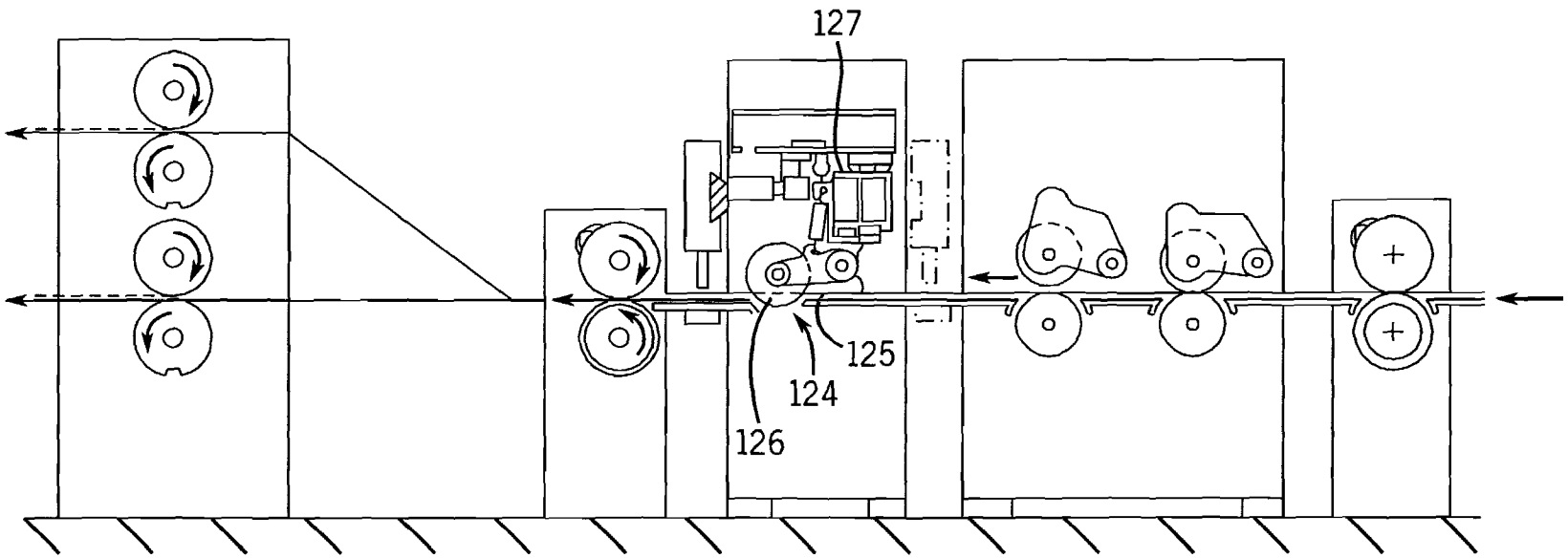
FIG. 4 PRIOR ART
FIG. 4 is a schematic side view of a prior art single-station, plunge-style, single-axis slitter/scorer.
Figure 5:
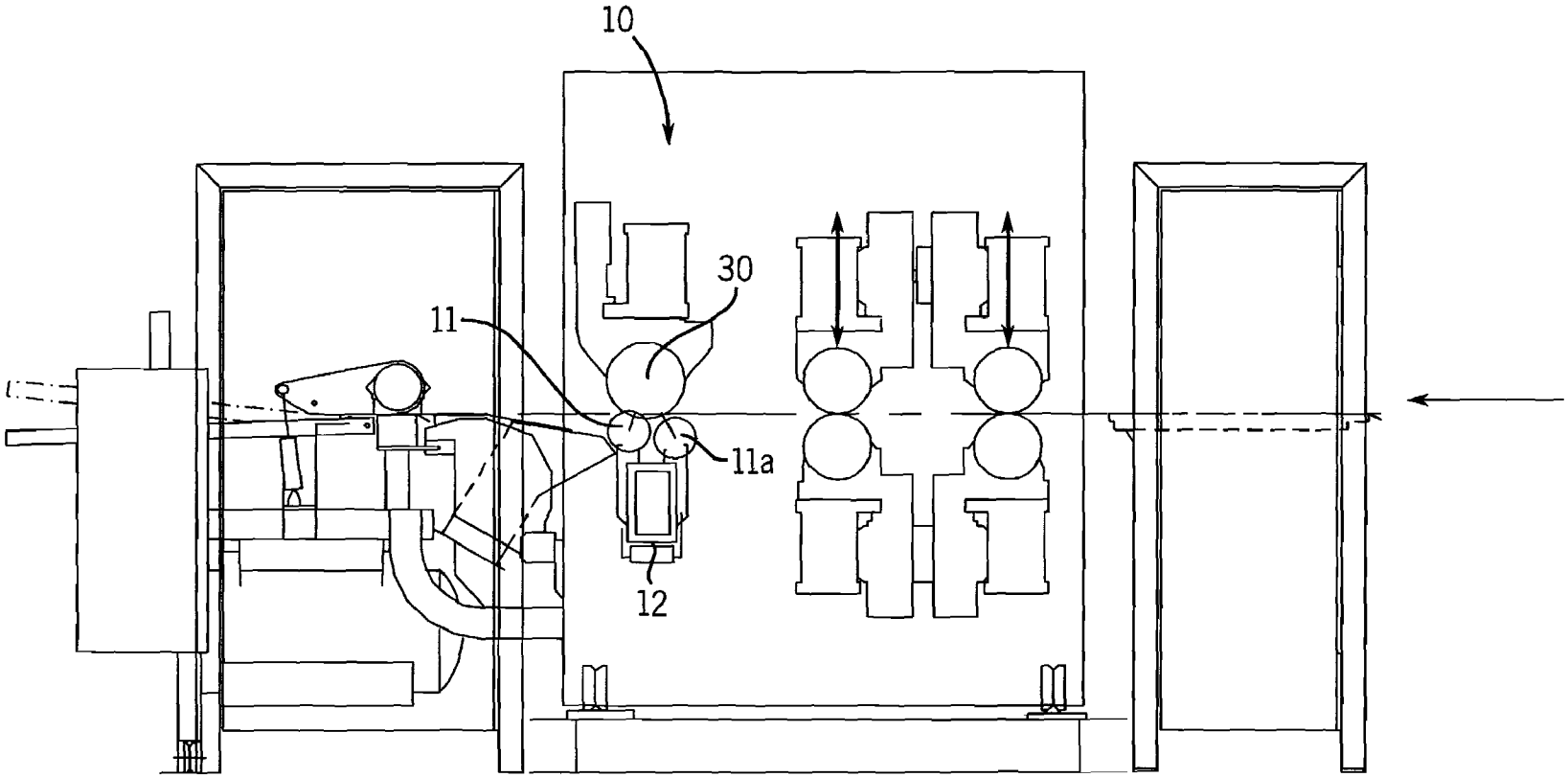
FIG. 5 is a schematic side view of a single-station, plunge-style, minimum-slit-head slitter/scorer of the present invention.
Figure 6:
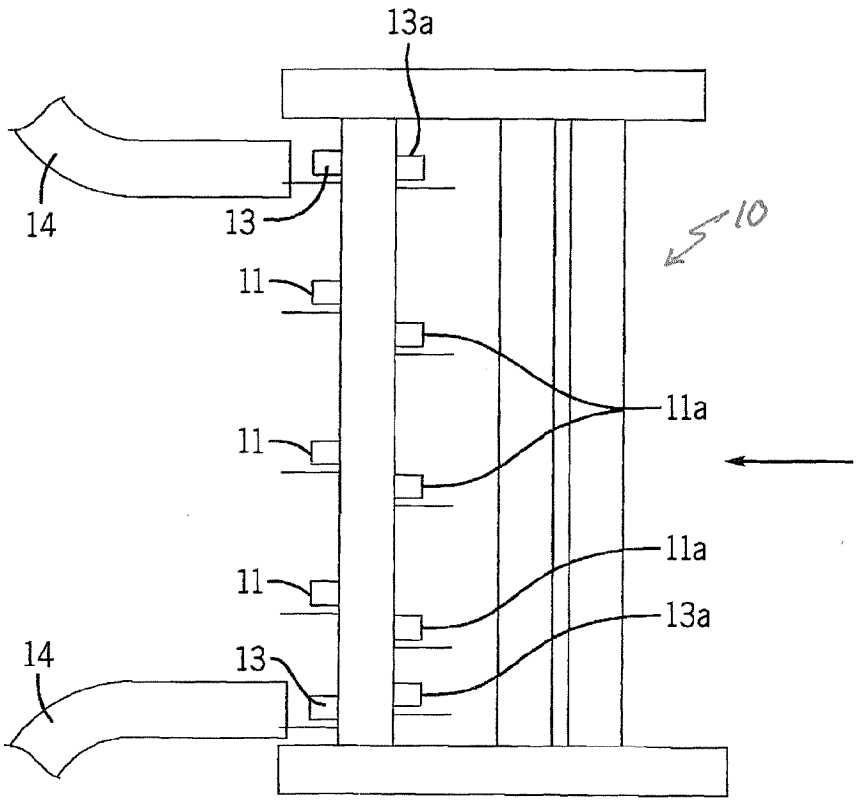
FIG. 6 is a schematic top view of a single-station, plunge-style, minimum-slit-head slitter/scorer of the present invention, showing dedicated trim slit heads.

FIG. 5 shows one embodiment of the single axis slitter/scorer 10 of the present invention. The slitter of the present invention, as also shown in FIG. 6, has three rotary plunge-style slit heads 11, 11*a* mounted on each side of a single tool support structure 12 for the preferred embodiment, or four fewer internal slit tools than the FIG. 4 prior art design. The slit heads or tools 11, 11*a* are operable to provide the slit lines defining the output webs or "outs" and will hereinafter be referred to as "internal" slitting heads or internal slitting tools to distinguish them from the edge trim slitting tools which will be described below. The present invention could be applied to the FIGS. 1 and 2 dual slit series prior art machines by also selecting heads from either series 110, 110*a* or 118, 118*a* to be run in any combination; however, the single slit head support structure 12 with single slit head positioning robot of the preferred embodiment will provide a more simple, inexpensive and reliable design. Although the plunge-style slitting tools 11 shown in FIG. 5 may slit into anvil rollers positioned below the board line, it is preferred to use a single brush anvil roll 30.

Figure 1:
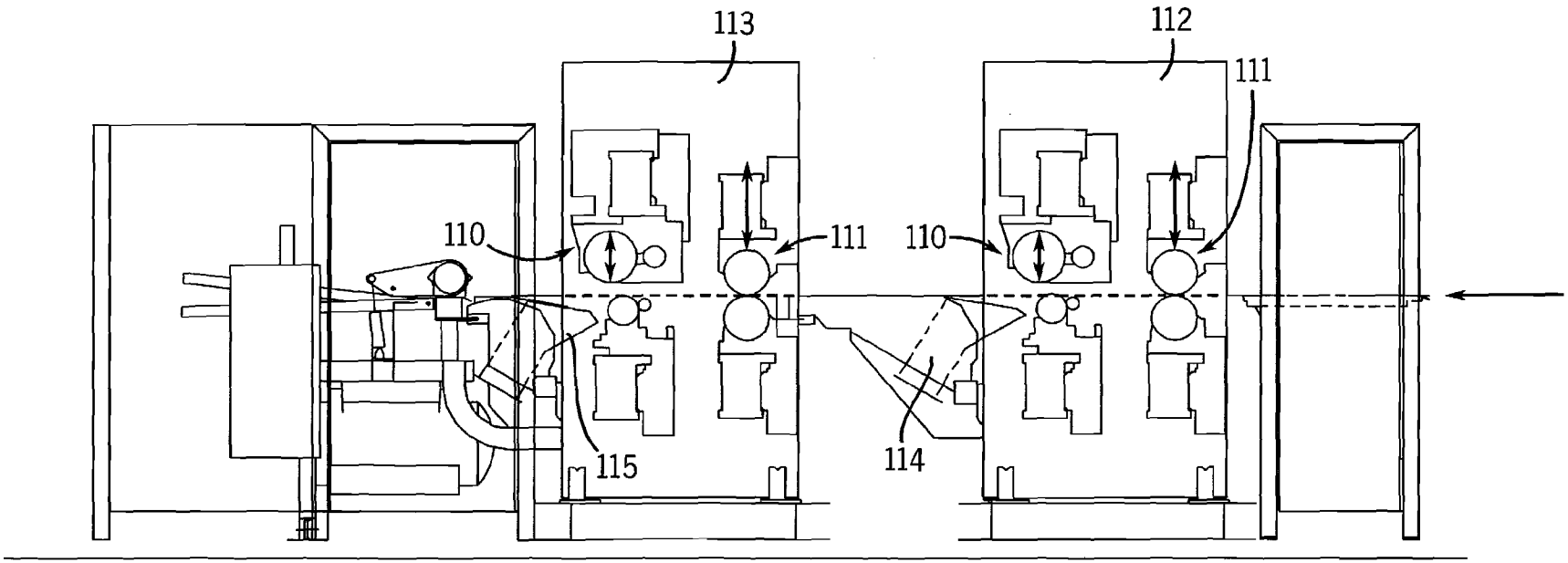
FIG. 1 PRIOR ART
FIG. 1 is a schematic side view of a prior art two-station plunge slitter/scorer.
Figure 2:
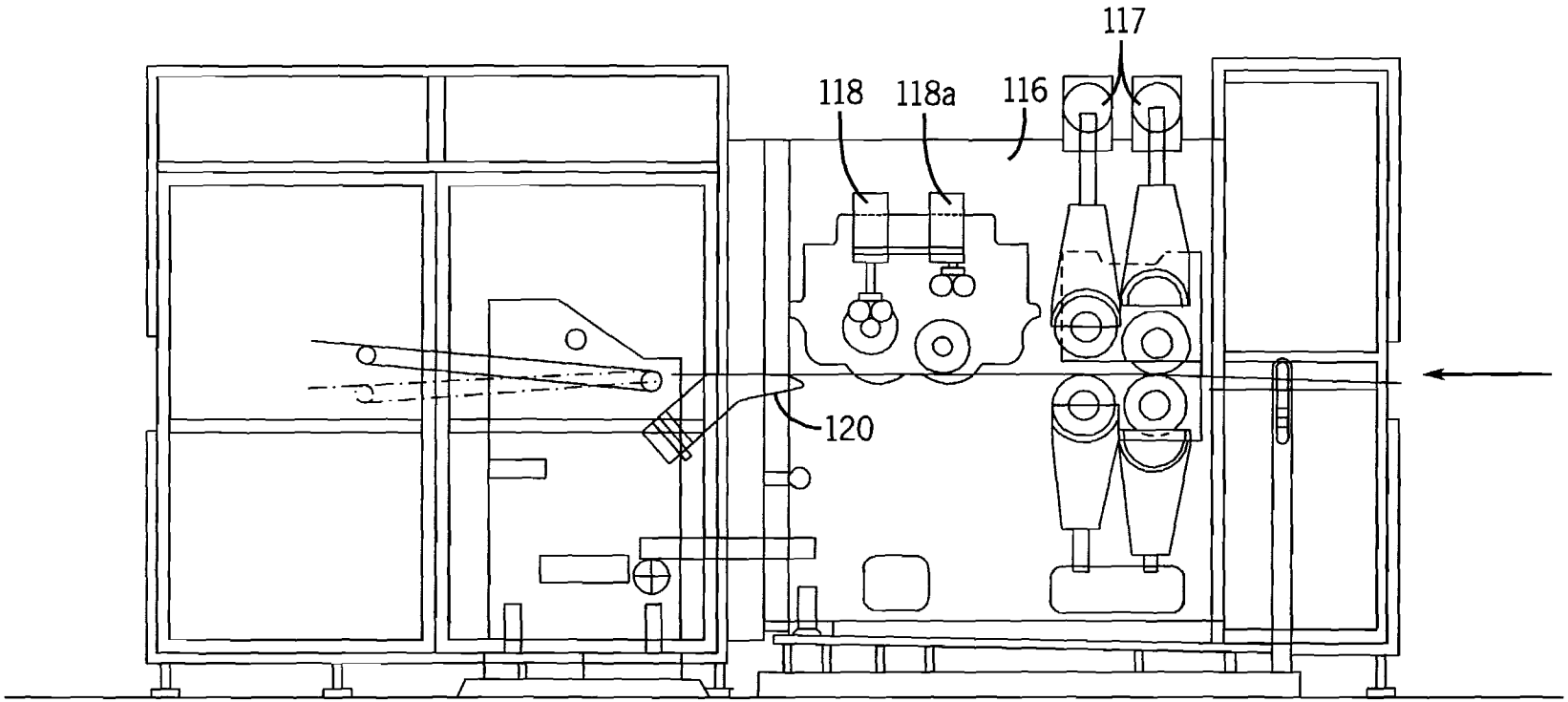
FIG. 2 PRIOR ART
FIG. 2 is a schematic side view of a prior art single-station, two-axis, plunge slitter/scorer.
Figure 3:
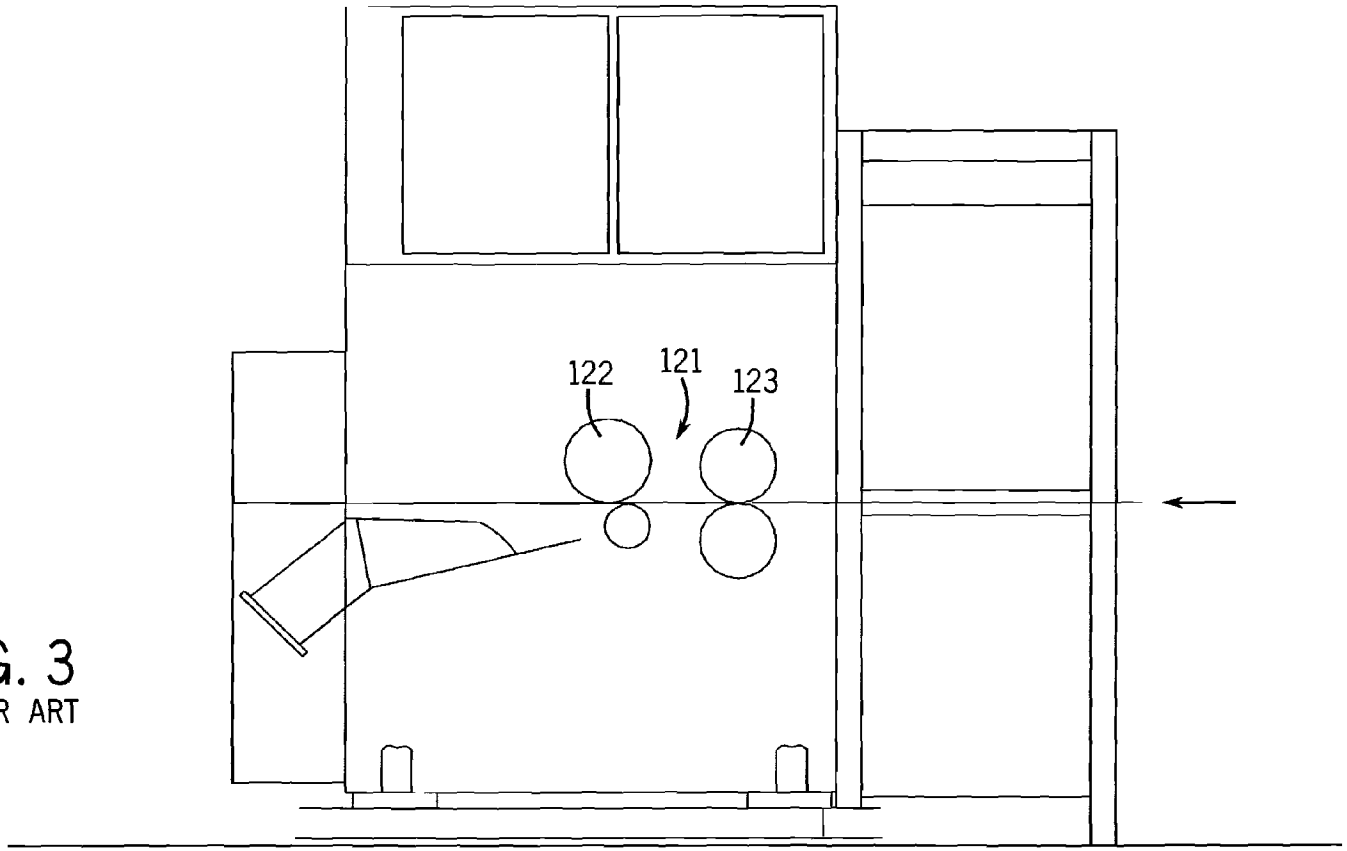
FIG. 3 PRIOR ART
FIG. 3 is a schematic side view of a prior art single-station, gap-style, quick setup, single-axis slitter/scorer.

The single axis slitter 10 of the present invention has dedicated trim slitting tools 13, 13*a* on each side and each end of the single slit axis, in addition to the internal slit heads 11, 11*a*. There will be a set of externally mounted trim chutes 14 as shown in FIG. 6. A problem associated with prior art two axes machines, as shown in FIG. 2, occurs at order change from the downstream slit axis 118 to the upstream slit axis 118*a*. In this situation, the trim created by the internal or upstream slit axis 118*a* must be shoved through the downstream slit axis 118 to reach the externally mounted trim chute 120. This has high potential for trim jam-up, particularly if the trim on the new order is very narrow. As a consequence, minimum trim widths are much wider than on slitters with multiple trim chutes 114, 115, such as shown in FIG. 1.

Figure 7:
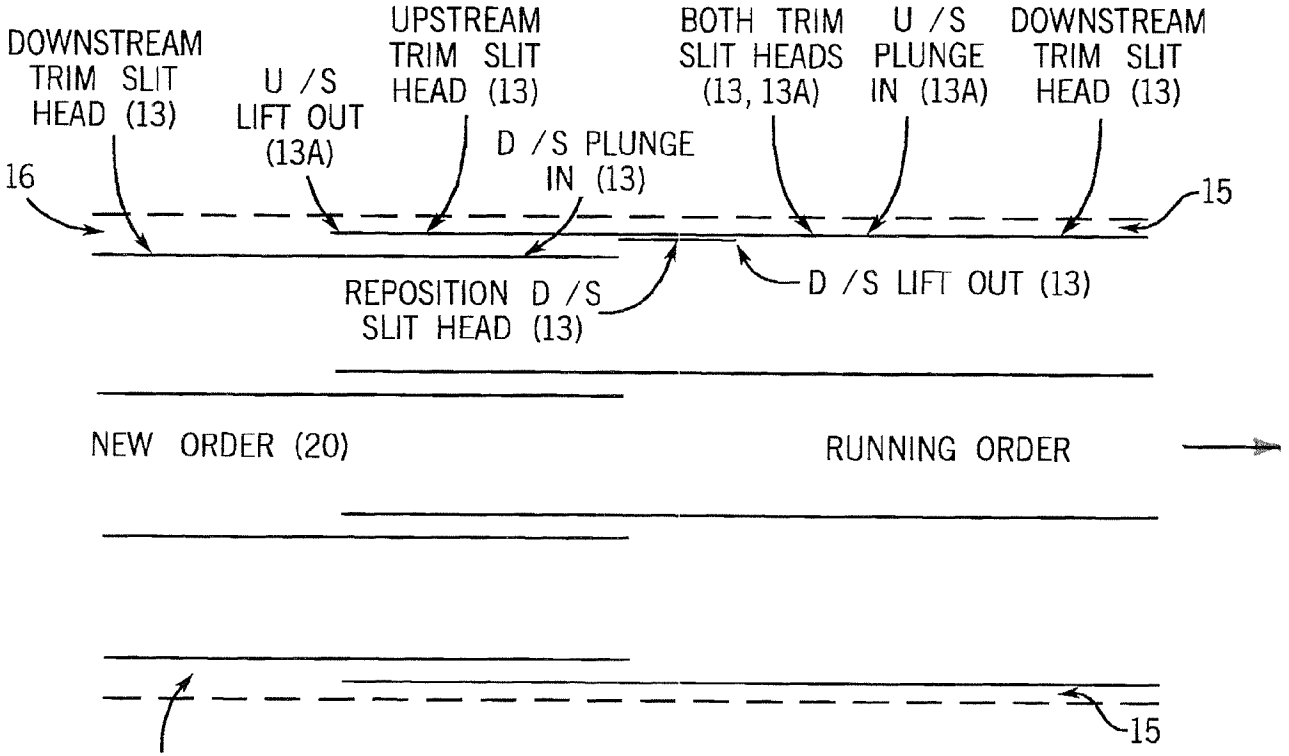
FIG. 7 is a schematic top view of a web with internal slit-out trim slits as required to complement the edge trim changeover of the present invention

This problem is solved by the present invention by a concept that always allows trim to be taken by the downstream dedicated trim slitting tool 13 of the FIG. 6 slitter/scorer 10. This is made possible by an aspect of the present invention whereby the dedicated trim slitting tool 13*a* on the upstream side of the single axis slitter plunges into the board line at the exact position of the current running dedicated trim slitting tool 13 on the downstream side of the slit axis with timing near the end of the old running order 18 as shown in FIG. 7. The timing is such that the dedicated trim slitting tool 13 on the downstream side of the slit axis then lifts up out of operative engagement with the running order trim 15 and is repositioned by the robot at the position required for the trim 16 of the new order 20. At order change, the dedicated trim slit tool 13*a* on the upstream side of the slit axis then lifts out of the boardline after the end of the current running order and the dedicated trim slit tool 13 on the downstream side of the single slit axis engages with the new order to create the new order trim 16. This eliminates the requirement to "shove" the trim from the upstream dedicated trim tool at an order change.

Figure 8:
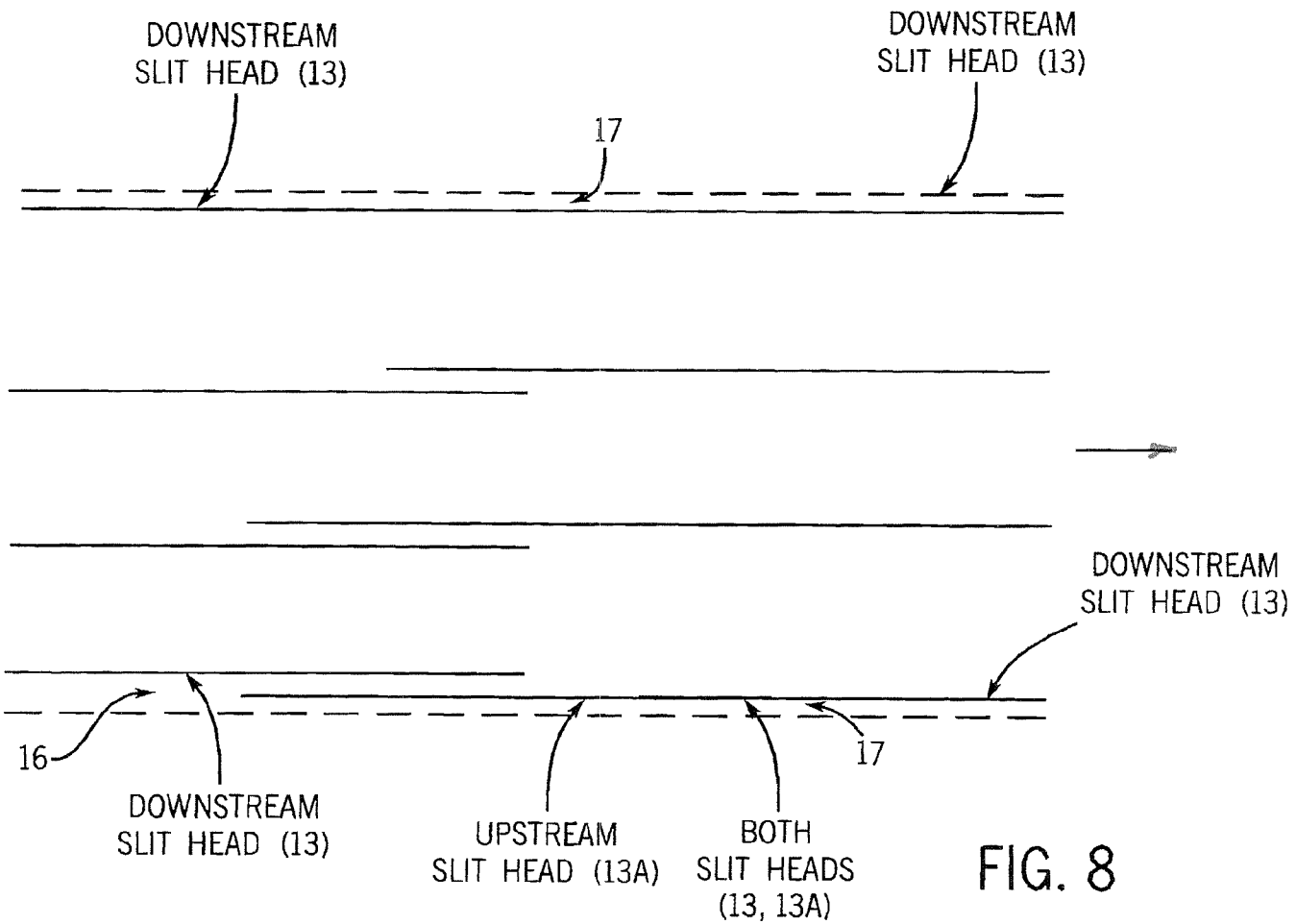
FIG. 8 is a schematic top view of a web with internal slit-out trim slits as required for an asymmetric trim order change.

Another aspect of the current invention involves the use of asymmetric trim to allow use of an otherwise dedicated upstream mounted trim slit tool 13*a* for internal web slitting. This occurs when going into or out of a five- or six-out order to maximize the number of slit heads available for the changeover. This method of order change involves leaving the dedicated trim slit tool 13 engaged in its currently running position at order changeover, as shown in FIG. 8. Since total out widths are different for each dry end setup made with a given running wet end corrugated web width, it is customary to take symmetric trim on each side of the slitter. But, if the five-or six-out is correctly positioned in the order queue, it is possible to do the order change by taking asymmetric trim 17 with one trim slit tool 13 not moved at order change. This, then, allows the dedicated trim slit tool 13*a* on the upstream side of the machine to be used for an internal board slit. This facilitates a plunge type order change for a greater number of outs with a minimal slitter/scorer slit tool configuration.

Another aspect of the present invention is the use of asymmetric trim and graceful degradation of the order change process from a gapless change to a gap-style change when making an order change from or to a five- or six-out. This allows the pre-set of unused slitting tools to be available during the running of the old order and then a positioning of the robot on one currently running tool 11, 11*a*, or 13*a* closely located in a cross corrugator position to the required position for the new order. At order change, a gap is pulled and the robot quickly positions the slit head 11, 11*a*, or 13*a* in the gap as the tailing out order clears the slitter. Alternately, the order change region as described in U.S. Patent Application Publication No. US2006/0090617 and shown in FIG. 5 thereof, could be extended in length to give the robot time as required to reposition the additional slitting tool. This aspect of the invention along with the asymmetric trim allows order change from or to a six-out from or to a four-out or less using a gap-style order change with a minimal complement of six total internal slit heads 11, 11*a*.

Another aspect of the current invention is the use of a rules-based order scheduling module to accommodate the specific limitations of the single axis plunge slitter that has a complement of six internal slit heads. In the normal scheduling of a corrugator, the scheduling software assumes that capability exists for solutions involving numbers of outs of successive orders in any combination up to the maximum possible. The solutions also assume the use of symmetric trim by the slitter setup controls and so only provides web width and out widths to derive a trim combination solution. The goal of this scheduling software is to pick order solutions that minimize the overall average trim widths in a wet end paper setup. There is a problem with this type of scheduling system when used on a corrugator with a slitter/scorer of the configuration of the present invention. The problem is that, in the absence of any rules to the contrary, the schedule solutions may well involve orders with number of outs on successive orders that exceed the capability of the slitter scorer. An objective of the slitter/scorer of the present invention is to reduce the overall cost of the machine by reducing the slit head complement. This reduced slit head machine cannot perform order changes on six-out to six-out or five-out back-to-back orders. The solution to this problem is to include a software module that will take the dry end setup solutions provided by the scheduling system and to reconfigure the sequence in which these orders are scheduled for the express purpose of eliminating six-out to six-out or five-out back-to-back orders. A second aspect of the solution is the selection of orders to precede or follow six-out or five-out orders with either two-out or three-out orders; or with three-out or four-out orders with trim width solutions that are wide enough to run asymmetric trim on the five-or six-out running order as well as the order following the five-out or six-out order. Failing any of the foregoing solutions , the software module will signal that a gap-style or extended order change zone gapless order is to be run, will select a running order head to be positioned by the robot in the gap or order change zone and schedule an asymmetric trim solution. The function, then, of the software module is to custom tailor the scheduling solutions to the specific capability of the slitter of the present invention. Since six-outs and five-outs are normally not common in the industry, this software module will succeed in all but the most unusual situation. Of course, if no successful solution in terms of dry end order sequence can be found using the rules-based software modules, then feedback is provided to the scheduling system indicating that different paper combinations will be required to run the orders.

It would be consistent with the present invention to add more internal slit heads to the slitter/scorer if a specific plant felt that there were good reasons why larger number of six-out and five-out orders would be scheduled. By adding two internal slit heads to each side of the single slit axis, it would be possible to schedule without constraint, six-out and five-out orders back-to-back, without asymmetric trim in the plunge order change mode of operation. The machine would then take on the characteristic of current technology two-axis solutions as epitomized by the FIG. 2 slitter/scorer. Short of the addition of these extra heads, the slitter would be used on a single-axis mode consistent with the present invention. It is also consistent with this invention to add an additional internal slit head to each side of the single tool support structure 10 to provide for up to eight-out slitting.

In FIG. 5, a rotary brush anvil 30 is used to support the web into which the rotary slitting tools 11, 11*a* plunge upwardly for slitting. The rotary brush anvil eliminates the need to utilize individually positionable anvil rollers. The brush anvil roller 30 preferably extends the full width of the web and, therefore, also provides the anvil for the dedicated trim slitting tools 13, 13*a*.

What is claimed is:

1. A method for slitting a continuous corrugated paperboard web to provide longitudinal edge trim slit line to define the lateral outside edge of an output web of a running order, the method comprising the steps of:

(1) providing a tool head support structure for transverse tool head movement across the web;

(2) mounting a pair of a downstream and an upstream trim slitting tool for selective positioning on said support structure, each slitting tool operable by selective positioning to establish the position of a web edge trim line;

(3) positioning the downstream trim slitting tool to plunge into the web to make the edge trim slit for the running order;

(4) positioning the upstream trim slitting tool on the line of the edge trim slit for the running order;

(5) plunging the upstream trim slitting tool into the edge trim slit line near the end of the running order to operate simultaneously with the downstream trim slitting tool;

(6) retracting the downstream trim slitting tool from the running order trim slit prior to the end of the running order;

(7) repositioning the downstream trim slitting tool for a new order trim slit line; and, (8) plunging the downstream trim slitting tool into the new order trim slit line at the beginning of the new order; and, (9) retracting the upstream trim slitting tool from the web at the end of the running order.

2. The method as set forth in claim 1 comprising the steps of:

(1) mounting a second pair of a downstream and an upstream trim slitting tool for selective positioning on said support structure, each trim slitting tool operable by selective positioning to establish the position of an opposite web edge trim line; and, (2) simultaneously operating both pairs of downstream and upstream trim slitting tools to provide edge trim slits on both edges of the web.

3. The method as set forth in claim 2 comprising the steps of:

(1) providing a group of internal slitting tools between the downstream trim slitting tools and the upstream trim slitting tools to make selectively positionable internal slits;

(2) operating the downstream trim slitting tool of one pair of a downstream and an upstream trim slitting tool to continue slitting on the running order trim slit line to extend the trim slit line into the new order; and, (3) utilizing the upstream trim slitting tool of the other pair in combination with tools from either of said internal slitting tool groups to provide an output web internal slit line.

4. A method for slitting a continuous corrugated paperboard web to provide a longitudinal edge trim slit line to define the lateral outside edge of an output web of a running order, the method comprising the steps of:

(1) providing a tool head support structure for transverse tool head movement across the web;

(2) mounting a first downstream trim slitting tool and a first upstream trim slitting tool on separate downstream and upstream axes for selective positioning, each first trim slitting tool operable by selective positioning to establish the position of a web edge trim line;

(3) positioning the first downstream trim slitting tool to plunge into the web to make the edge trim slit for the running order;

(4) positioning the first upstream trim slitting tool on the line of the edge trim slit for the running order;

(5) plunging the first upstream trim slitting tool into the edge trim slit line near the end of the running order to operate simultaneously with the first downstream trim slitting tool;

(6) retracting the first downstream trim slitting tool from the running order trim slit prior to the end of the running order;

(7) repositioning the first downstream trim slitting tool for a new order trim slit line; and, (8) plunging the downstream trim slitting tool into the new order trim slit line at the beginning of the new order; and, (9) retracting the first upstream trim slitting tool from the web at the end of the running order.

5. The method as set forth in claim 4 comprising the steps of:

(1) mounting a second downstream trim slitting tool on the downstream axis and a second upstream trim slitting tool on the upstream axis for selective positioning, each second trim slitting tool operable by selective positioning to establish the position of an opposite web edge trim line; and, (2) simultaneously operating both pairs of first and second trim slitting tools to provide edge trim slits on both edges of the web.

6. The method as set forth in claim 5 comprising the steps of:

(1) providing each axis with a group of selectively positionable internal slitting tools;

(2) operating the second downstream trim slitting tool to continue slitting on the running order trim slit line to extend the trim slit line into the new order; and, (3) utilizing the second upstream trim slitting tool with tools from either of said internal slitting tool groups to provide an output web internal slit line.

7. A method for slitting a continuous corrugated paperboard web to provide longitudinal slit lines dividing the web into a plurality of output webs of selected widths and not exceeding a selected maximum number, the method comprising the steps of:

(1) providing a unitary tool head support structure defining a single transverse axis across the web;

(2) mounting a number of internal web plunge slitting tools comprising a minimum number equal to the selected maximum number of output webs for selective positioning along said axis with the internal slitting tools divided into a downstream group and an upstream group, each group selectively positionable along the axis without interfering contact with the internal slitting tools of the other group;

(3) utilizing a single robotic positioner operable along said axis to position a selected number of internal slitting tools from one or both groups for an order of output webs to be run, the selected number of slitting tools corresponding to one less than the number of output webs to be run and plunging said selected slitting tools into the running web;

(4) while the order is running, utilizing the robotic positioner to position any number of unused internal slitting tools from either group for a following new order; and including the additional steps of:

(5) mounting a pair of a downstream and an upstream trim slitting tool for selective positioning along said axis, each pair operable by the robotic positioner to establish the position of a web edge trim line;

(6) positioning the downstream trim slitting tool to plunge into the web to make the edge trim slit for the running order;

(7) positioning the upstream trim slitting tool on the line of the edge trim slit;

(8) plunging the upstream trim slitting tool into the edge trim slit line near the end of the running order to operate simultaneously with the downstream trim slitting tool;

(9) retracting the downstream trim slitting tool from the running order trim slit;

(10) repositioning the downstream trim slitting tool for the new order trim slit line;

(11) plunging the downstream trim slitting tool into the new order trim slit line at the beginning of the new order; and

(12) retracting the upstream trim slitting tool from the web at the end of the running order.

8. The method as set forth in claim 7 including the steps of:

(1) providing no more than six internal slitting tools; and (2) allocating the slitting tools into said downstream and upstream groups in equal or one less than equal numbers.

9. The method as set forth in claim 7 comprising simultaneously performing an edge trim with a second pair of a downstream and an upstream trim slitting tools on the other edge of the web.

10. The method as set forth in claim 9 comprising the steps of:

(1) operating the downstream trim slitting tool of the second pair of a downstream and an upstream trim slitting tool to continue slitting on the running order trim slit line to extend the trim slit line into the new order; and, (2) utilizing the upstream trim slitting tool of said second pair in combination with tools from either of said internal slitting tool groups to provide an output web internal slit line.

11. The method as set forth in claim 10 comprising the steps of:

(1) utilizing six internal slitting heads; and, (2) scheduling orders to be run to prevent consecutive orders of the maximum number of output webs and no more than three output webs.

12. The method as set forth in claim 11 comprising the step of adding an internal slitting tool to the number of internal slitting tools to increase the maximum number of output webs in consecutive orders by one.

13. The method as set forth in claim 8 wherein six internal slitting tools are provided, and the allocating step comprises allocating three internal slitting tools to each group.

14. The method as set forth in claim 8, including use of a special scheduling system software module capable of analyzing the dry end orders within a wet end set up to determine if there are one fewer slit heads available than required to execute scheduled back-to-back orders and, if so, implementing a gap style or extended order change zone gapless style order change wherein a running order slit head is repositioned by the robot in the gap or extended order change zone of a gapless order change to the new order location to provide an adequate number of slit heads to be available for the following order.

15. The method as set forth in claim 8, including use of a special scheduling system software module that can reconfigure the sequence of dry end orders in a wet end setup for the purpose of:

(1) eliminating six out to six out or six out to five out orders, and performing one of the steps of:

(2) scheduling orders of no more than three outs to precede or follow an order of at least five outs, or (3) scheduling orders of no more than four outs to precede or follow an order of at least five outs if asymmetric trim can be taken on one side of the web on the running and new orders.

16. The method as set forth in claim 8 comprising the step of adding one or more internal slitting tools to the number of internal slitting tools to increase the maximum number of output webs in consecutive orders.

* * * * *